US007665781B2

(12) United States Patent
Drexler

(10) Patent No.: US 7,665,781 B2
(45) Date of Patent: Feb. 23, 2010

(54) PORTABLE ANIMAL WASTE PICK UP AND STORAGE APPARATUS

(76) Inventor: Susan Drexler, 163 Thomas Dr., Wernersville, PA (US) 19565

( * ) Notice: Subject to any disclaimer, the term of this patent is extended or adjusted under 35 U.S.C. 154(b) by 469 days.

(21) Appl. No.: 11/505,209

(22) Filed: Aug. 16, 2006

(65) Prior Publication Data

US 2007/0039897 A1 Feb. 22, 2007

Related U.S. Application Data

(60) Provisional application No. 60/708,341, filed on Aug. 16, 2005.

(51) Int. Cl.
*A01K 29/00* (2006.01)
*E01H 1/12* (2006.01)
*A45F 3/44* (2006.01)

(52) U.S. Cl. ..... 294/1.3; 220/908; 248/156

(58) Field of Classification Search ..... 294/1.1, 294/1.3, 1.4, 1.5, 55; 119/161; 220/735, 220/908, 908.1; 248/98, 156
See application file for complete search history.

(56) References Cited

U.S. PATENT DOCUMENTS 3,666,222 A * 5/1972 Griggers ..... 248/146
D234,304 S * 2/1975 Schmieler ..... D30/162
4,152,003 A * 5/1979 Reineccius et al. ..... 280/47.18
4,953,744 A * 9/1990 Koyama ..... 220/495.11
5,088,448 A 2/1992 Gladding
5,134,974 A * 8/1992 Houser ..... 119/168
5,503,442 A * 4/1996 Lee ..... 294/1.4
5,511,682 A * 4/1996 Pace ..... 280/47.26
5,636,852 A * 6/1997 Sistrunk et al. ..... 280/30
5,799,993 A * 9/1998 Lafferty ..... 294/1.4
6,079,363 A 6/2000 MacLaine
6,446,903 B1 9/2002 Bazan
6,705,577 B1 * 3/2004 Grimes ..... 248/154

* cited by examiner

*Primary Examiner*—Dean J Kramer
(74) *Attorney, Agent, or Firm*—James Ray & Assoc

(57) ABSTRACT

A portable apparatus for picking up and storing waste and, particularly animal waste, includes a container having each of a predetermined shape and a predetermined size, a bottom wall, and a side wall extending upwardly from the bottom wall and forming an open top end. An elongated member with a pointed lower edge is provided for securing the apparatus to a ground surface in a semi-permanent fashion. There is a pair of hooks for securing the handles of a grocery type bag positioned within an interior portion of the container. An optional liner storage member is attached to the exterior surface of the container. The invention also provides a device for picking up the animal waste which includes a cup-shaped member mounted at one end of an elongated member and a handle which is mounted at a distal end of the elongated member.

2 Claims, 2 Drawing Sheets

PORTABLE ANIMAL WASTE PICK UP AND STORAGE APPARATUS

CROSS-REFERENCE TO RELATED APPLICATIONS

This application is related to and claims priority from Provisional Patent Application Ser. No. 60/708,341 filed Aug. 16, 2005.

FIELD OF THE INVENTION

The present invention relates, in general, to waste storage systems and, more particularly, this invention relates to a portable animal waste storage apparatus which can be easily transported and secured in a semi-permanent fashion to a ground surface and which incorporates a device for picking up such animal waste.

BACKGROUND OF THE INVENTION

One difficulty continuously experienced by pet owners is that generally only a thin layer of plastic material separates their hand from animal waste when such waste is to be picked up. Therefore, any breach in the plastic material may expose the owner's hand to undesirable bacteria contained in the animal waste.

Another difficulty continuously experienced by pet owners is that picked up waste is stored in the same trash container that is used for general household waste and therefore the owner may experience unpleasant odor when depositing household waste into the container.

As it generally known, prior art waste storage containers when left standing in an open area provide little resistance to a strong wind and therefore the waste contents may spill out from the container necessitating an undesirable clean-up effort.

Furthermore, as is generally well known, presently available waste storage containers either for indoor or outdoor use are constructed to accept specially made plastic bags. Accordingly, those who desire to recycle plastic bags used for packing groceries or other goods are disadvantaged when attempting to fit such plastic bags into the available waste storage containers.

SUMMARY OF THE INVENTION

According to one embodiment, the invention provides an apparatus for storing waste. The apparatus includes a container having each of a predetermined shape and a predetermined size, a bottom wall, and a side wall extending upwardly from the bottom wall and forming an open top end. Means positioned adjacent an exterior surface of the side wall is provided for securing the apparatus to a ground surface in a semi-permanent fashion. There is a mounting means which is attached to the container for selectively mounting the apparatus securing means for a sliding movement between a first position wherein a lower end of the apparatus securing means extends beyond the bottom wall of the container and penetrates such ground surface and a second position wherein the lower end of the apparatus securing means is elevated above such ground surface sufficiently to move the apparatus.

According to another embodiment of the invention, there is provided an apparatus for storing waste. The apparatus includes a container having each of a predetermined shape and a predetermined size, a bottom wall, and a side wall extending upwardly from the bottom wall and forming an open top end. There is means attached to a predetermined portion of the container for securely capturing an opened end of a plastic liner positioned within a hollow portion of the container.

According to yet another embodiment, the invention provides an apparatus for storing waste. The apparatus includes a container having each of a predetermined shape and a predetermined size, a bottom wall, and a side wall extending upwardly from the bottom wall and forming an open top end. Means is attached to an exterior surface of the side wall for removably storing a plurality of plastic liners each positionable within a hollow portion of the container for receiving the waste.

According to a further embodiment of the invention, there is provided a waste pick up device for use with a waste storage apparatus. The device includes a generally cup-shaped member engageable with and temporarily retaining such waste. An elongated member extends outwardly from the cup-shaped member. A handle means is attached to a distal end of the elongated member. Means formed on a portion of the cup-shaped member is provided for preventing unintentional withdrawal of such picked up waste during carrying of the device by a user holding the device by one of the handle means and the elongated member.

OBJECTS OF THE INVENTION

It is, therefore, one of the primary objects of the present invention to provide an improved waste storage apparatus.

Another object of the present invention is to provide a waste storage apparatus which can be easily and simply secured to a ground surface.

Yet another object of the present invention is to provide a waste storage apparatus which employs a pair of wheels for ease of movement.

A further object of the present invention is to provide a waste storage apparatus which enables recycling of plastic bags used for packing groceries.

Yet a further object of the present invention is to provide a waste storage apparatus which incorporates a device for picking up animal waste.

An additional object of the present invention is to provide a waste storage apparatus which includes a hinged lid.

In addition to the several objects and advantages of the present invention which have been described with some degree of specificity above, various other objects and advantages of the invention will become more readily apparent to those persons who are skilled in the relevant art, particularly, when such description is taken in conjunction with the attached drawing Figures and with the appended claims.

BRIEF DESCRIPTION OF THE VARIOUS EMBODIMENTS OF THE INVENTION

Figure 1:
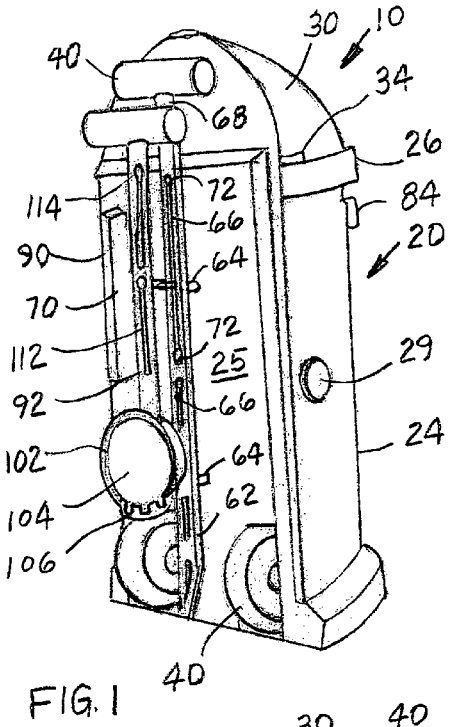
FIG. 1 is a rear perspective view of a portable animal waste pick up and storage apparatus.
Figure 2:
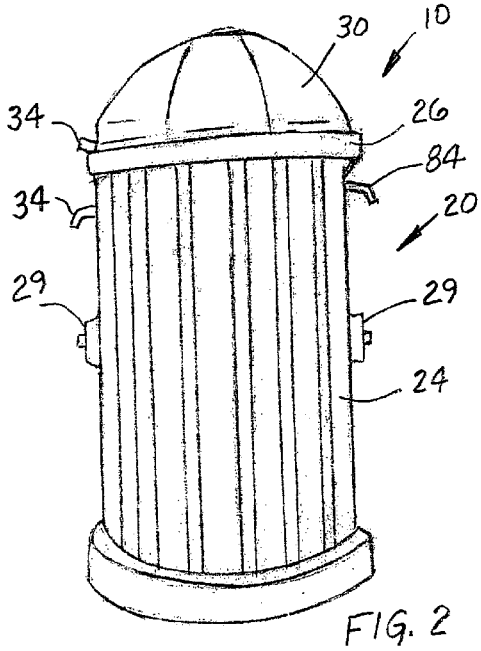
FIG. 2 is a front view of the animal waste pick up and storage apparatus of FIG. 1 illustrating a hydrant like shape of such apparatus.

Prior to proceeding to the more detailed description of the present invention, it should be noted that, for the sake of clarity and understanding, identical components which have identical functions have been identified with identical reference numerals throughout the several views illustrated in the drawing figures.

Reference is now made, to FIGS. 1-8, wherein there is shown an apparatus, generally designated 10, for storing waste. Such waste storage apparatus 10 includes a container, generally designated 20, which has each of a predetermined shape and a predetermined size. The container 20 is formed by a bottom wall 22 and a side wall 24 which extends upwardly from the bottom wall 22 and forms an open top end 28. The container 20 is manufactured from a preselected material. A presently preferred material of container 20 is plastic.

The apparatus 10 may be provided with a lid 30 which engages a top portion 26 of the side wall 24 for selectively closing and opening the open top end 28 of the container 20. As it is well known in the art, the apparatus 10 may include a hinge means 34 connected to top portion 26 of side wall 24 and to an edge portion 32 of lid 30 for hingeably connecting lid 30 to the open top end 28 of container 20.

Figure 3:
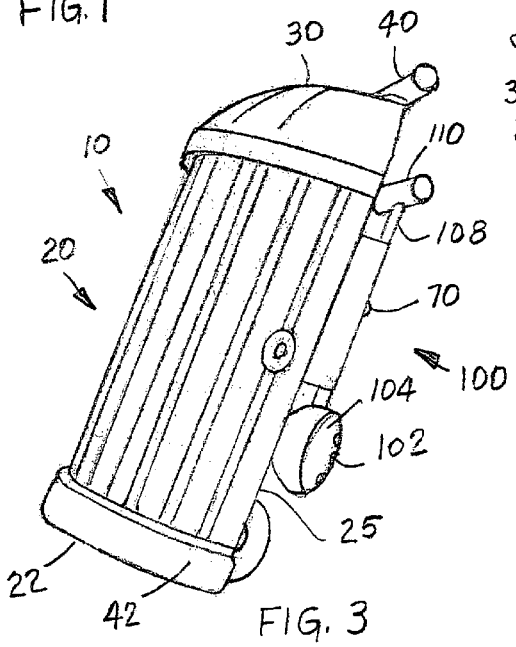
FIG. 3 is a side perspective view of the animal waste pick up and storage apparatus of FIG. 1 illustrating such apparatus in a tilted position during movement.
Figure 4:
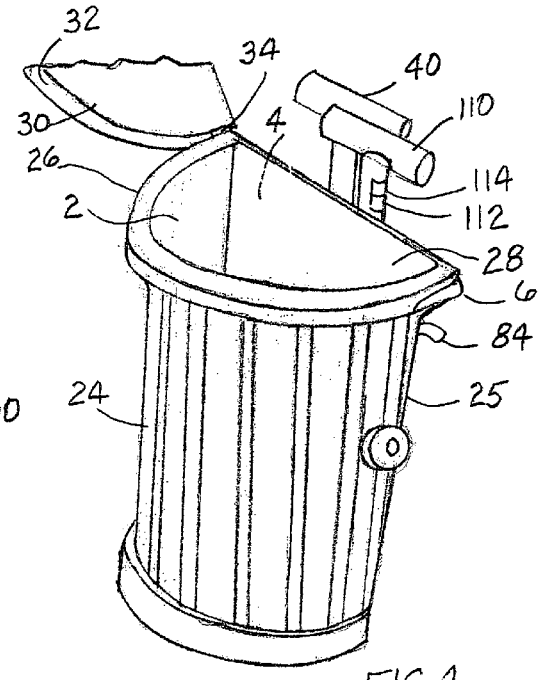
FIG. 4 is perspective view of the animal waste pick up and storage apparatus of FIG. 1 illustrating attachment of a grocery type plastic bag according to one embodiment of the invention.

The apparatus 10 may include an optional pair of wheels 40 for ease of moving the apparatus 10. Accordingly, there is a pair pockets 42 formed in the bottom wall 22 of the container 20 and in a rear surface portion 25 of side wall 24. Each wheel 40 is rotatably mounted within a respective one of the pair of pockets 42, whereby the container 10 tilted towards the rear surface portion 25 is movable by the pair of wheels 40, as best shown in FIG. 3.

To aid in moving the apparatus 10 being tilted toward the rear surface portion 25 of the side wall 24, a handle means 40 is attached to one of the container 20 and the lid 30.

The presently preferred apparatus 10 is approximately 14.0 inches wide, 26.0 inches high and 10.0 inches deep.

Figure 7:
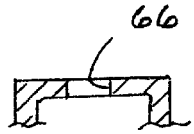
FIG. 7 is a cross-sectional view of the animal waste pick up and storage apparatus taken along the lines 7-7 of FIG. 6.

According to one other embodiment of the invention, the apparatus 10 includes means engageable with an exterior surface of the side wall 24 for securing the apparatus 10 to one of a ground surface and a stationary object in a semi-permanent fashion. In the presently preferred embodiment of the invention, such apparatus securing means is provided for securing the apparatus 10 to the ground surface and includes a generally elongated member 60 which has a pointed end 62 capable of penetrating such ground surface for a predetermined distance. The member 60 is positioned adjacent the rear surface portion 25 of the wall surface 24. As best shown in FIG. 7, the elongated member 60 has a U-shaped cross-section, although such elongated member 60 may have an H-shaped cross-section or any other shape suitable to provide rigidity of the elongated member 60 for securing such apparatus 10 to the ground surface.

The apparatus 10 further includes a mounting means attached to the rear surface portion 25 for selectively mounting the elongated member 60 for sliding movement between a first position wherein the bottom pointed end 62 extends beyond the bottom wall 22 of the container 20 and penetrates such ground surface and a second position wherein the bottom pointed end 62 is elevated above such ground surface sufficiently to move the apparatus 10.

In the presently preferred embodiment of the invention, such mounting means includes a pair of vertically spaced pin members 64 attached to the rear surface portion 25 and extending outwardly therefrom and at least one and preferably a pair of elongated slots 66 formed in the elongated member 60 for receiving such pair of pin members 64.

When such elongated member 60 is disposed in the second position, its top end 68 is positioned at least adjacent the top portion 26 of the side wall 24 and the handle means 40 is advantageously attached to such top end 68. The top end 68 is allowed to extend beyond open top end 28 of the container 20 for moving the apparatus 10.

The distal end of each pin member 64 is adapted with a mushroom type head 70 and one end of the slot 66 is provided with a complimentary aperture 72 sized to receive such mushroom type head 70. Presence of the mushroom type head 70 prevents unintentional detachment of the elongated member 60 from the container 20 while enabling its attachment to and removal from the apparatus 10 when the mushroom type head 70 is aligned with aperture 72.

Figure 8:
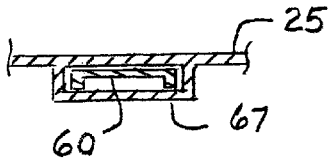
FIG. 8 is a cross-sectional view of the animal waste pick up and storage apparatus taken along the lines 8-8 of FIG. 6.

Alternatively or in combination with the pin members 64, such mounting means may include a simple U-shaped guide 67 formed on the rear surface portion 25 of the side wall 24 as best shown in FIG. 8.

According to another embodiment, the invention provides for securely capturing an open end 4 of a plastic liner 2 positioned within a hollow portion of container 20.

Figure 5:
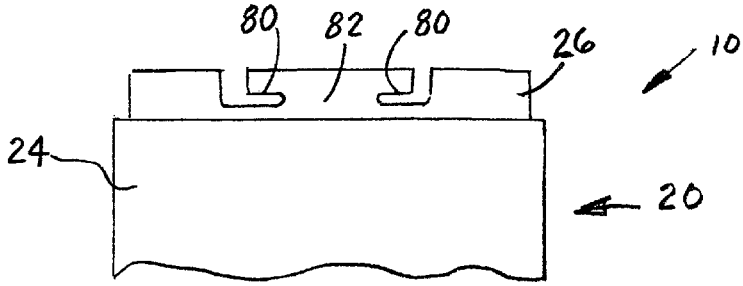
FIG. 5 is a partial rear elevation view of the animal waste pick up and storage apparatus of FIG. 1 illustrating attachment of the grocery type plastic bag according to another embodiment of the invention.
Figure 6:
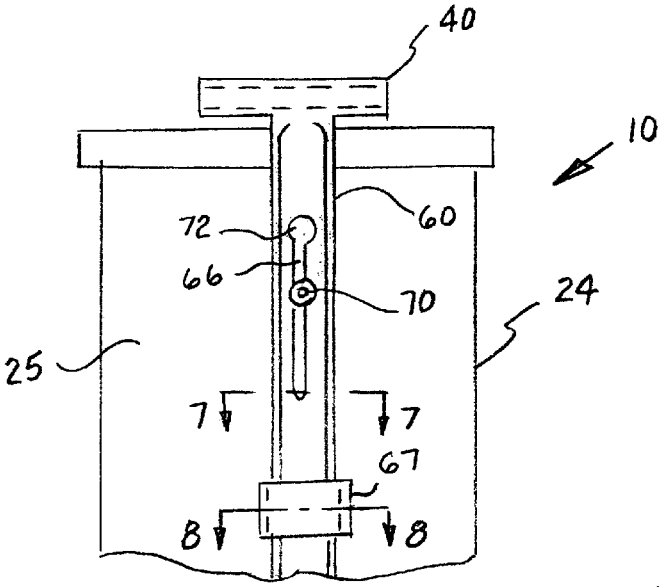
FIG. 6 is a partial rear elevation view of the animal waste pick up and storage apparatus of FIG. 1 illustrating attachment of a member for securing the apparatus to a ground surface.

The open end 4 of the plastic liner 2 may be captured by a plurality of L-shaped slots 80 formed in the top portion 26 of the side wall 24 and arranged in a pair like fashion, wherein the slots 80 of each pair face each other to form a generally T-shaped segment 82 within the top portion 26 as best shown in FIG. 5. It has been found that such arrangement of slots 80 provides for attaching liners 2 which have handles 6, such as plastics bags used for packing groceries. Therefore, such grocery type bags can be easily recycled for storing waste.

Alternatively, the apparatus 10 may include a pair of L-shaped hooks 84 attached to the exterior surface of the side wall 24 for receiving handles 6 of the plastic bag 2.

According to yet another embodiment of the invention, apparatus 10 includes a provision for storing a plurality of plastic liners 2. There is an enclosure 90 attached to the exterior surface of the side wall 24 for receiving such plurality of plastic liners 2. The enclosure 90 may be formed as a hollow cylinder having a closed top end and the opposed open bottom end for receiving a roll of plastic liners 2. A lid 92 is then provided for closing the open bottom end. Alternatively, the enclosure 90 may be formed as a generally rectangular pocket (not shown) for receiving a box (not shown) containing such plurality of plastic liners 2. Alternatively, handle means 40 may be employed to receive such plastic liners 2.

According to a further embodiment of the invention, the front portion of the side wall 24 is formed to resemble a conventional fire hydrant and the apparatus 10 further includes a pair of decorative disk members 29 attached in a predetermined location to such side wall 24 to further enhance appearance of the fire hydrant.

According to yet a further embodiment, the invention provides a waste pick up device, generally designated 100, for use with a waste storage apparatus 10. The device 100 includes a generally cup-shaped member 102 for picking up and temporarily retaining such waste. An inward lip 106 is partially formed on a peripheral outer edge 104 of cup-shaped member 102 for preventing unintentional discharge of such waste during carrying of the device 100 by a user. An elongated member 108 extends outwardly from a peripheral edge 104 of cup-shaped member 102. A handle means 110 is attached to a distal end of the elongated member 108. Preferably, the cup-shaped member 102, the elongated member 108 and the handle means 110 are integrally formed as a one-piece member from a plastic material.

In the presently preferred embodiment of the invention, the device 100 includes means for releaseably attaching the device 100 to such waste storage apparatus 10. Advantageously, the device 100 includes an elongated slot 112 adapted with an aperture 114 at one end for engaging the pin member 64 employed for attaching the elongated member 60 to the apparatus 10. As it has been described above, presence of the mushroom type head 70 prevents unintentional detachment of the device 100 from the container 20 while enabling its attachment to and removal from the container when the mushroom type head 70 is aligned with aperture 114.

Although, the cup-shaped member 102 is shown as formed generally planar to the elongated member 108, it will be understood that such cup-shaped member 102 may be formed generally perpendicular to the elongated member 108.

Thus, the present invention has been described in such full, clear, concise and exact terms as to enable any person skilled in the art to which it pertains to make and use the same. It will be understood that variations, modifications, equivalents and substitutions for components of the specifically described embodiments of the invention may be made by those skilled in the art without departing from the spirit and scope of the invention as set forth in the appended claims.

I claim:

1. A waste pick up device for use with a waste storage apparatus, said device comprising:

(a) a generally cup-shaped member engageable with and temporarily retaining such waste;

(b) an elongated member extending outwardly from said cup-shaped member;

(c) a handle means attached to a distal end of said elongated member;

(d) means formed on at least a portion of said cup-shaped member for preventing unintentional discharge of such picked up waste during carrying of said device by a user holding said device by one of said handle means and said elongated member; and (e) means for releaseably attaching said device to such waste storage apparatus wherein said releaseably attaching means includes at least one elongated slot and an aperture formed at one end of said at least one elongated slot, said aperture is larger than a width of said at least one elongated slot and wherein such apparatus includes at least one pin member extending outwardly from an exterior surface of such a container portion of such waste storage apparatus and passing through said at least one elongated slot, such at least one pin member having a mushroomed cap formed at a distal end thereof and sized to fit said aperture, whereby such mushroomed cap is aligned with said aperture for selectively attaching said waste collection device to and removing it from such waste storage apparatus.

2. An apparatus for storing waste, said apparatus comprising:

(a) a container having each of a predetermined shape and a predetermined size, a bottom wall, and a side wall extending upwardly from said bottom wall and forming an open top end;

(b) means positioned adjacent an exterior surface of said side wall for securing said apparatus to a ground surface in a semi-permanent fashion, said means including an elongated member having a pointed lower end which is oriented toward a ground surface and which is capable of penetrating such ground surface; and (d) a mounting means attached to said container for selectively mounting said apparatus securing means for a sliding movement between a first position wherein a lower end of said apparatus securing means extends beyond said bottom wall of said container and penetrates such ground surface and a second position wherein said lower end of said apparatus securing means is elevated above such ground surface sufficiently to move said apparatus, said mounting means including at least one elongated slot formed in said apparatus securing means and an aperture formed at one end of said at least one elongated slot, said aperture is larger than a width of said at least one elongated slot and wherein said apparatus includes at least one pin member extending outwardly from said exterior surface of said container and passing through said at least one elongated slot, said at least one pin member having a mushroomed cap formed at a distal end thereof and sized to fit said aperture, whereby said mushroomed cap is aligned with said aperture for selectively attaching said apparatus securing means to and removing it from said waste storage apparatus and whereby said at least one pin member enables said sliding movement of said apparatus securing means between said first and said second position.

* * * * *